United States Patent [19]

Reinhardt

[11] Patent Number: 4,970,941

[45] Date of Patent: Nov. 20, 1990

[54] ELECTRICAL MEASURED VALUE PROCESSING FOR A CONTROL VALVE

[75] Inventor: Peter Reinhardt, Lohr, Fed. Rep. of Germany

[73] Assignee: Mannesmann Rexroth GmbH, Lohr, Fed. Rep. of Germany

[21] Appl. No.: 449,041

[22] Filed: Dec. 14, 1989

Related U.S. Application Data

[63] Continuation of Ser. No. 257,464, Oct. 13, 1988, abandoned.

[30] Foreign Application Priority Data

Oct. 15, 1987 [DE] Fed. Rep. of Germany ..... 3734955

[51] Int. Cl.[5] ..... F15B 13/044

[52] U.S. Cl. ..... 91/433; 91/459; 137/625.64; 137/625.65; 137/884

[58] Field of Search ..... 91/433, 459; 137/625.64, 625.65, 884

[56] References Cited

U.S. PATENT DOCUMENTS 4,031,813 6/1977 Walters et al. ..... 91/433

4,061,155 12/1977 Sopha ..... 91/433 X 4,714,005 12/1987 Leemhuis ..... 137/624.11 X 4,724,865 2/1988 Hirano et al. ..... 137/487.5 X 4,798,527 1/1989 Gunda ..... 137/487.5 X

FOREIGN PATENT DOCUMENTS 2754878 6/1979 Fed. Rep. of Germany ..... 137/625.64

*Primary Examiner*—Gerald A. Michalsky

*Attorney, Agent, or Firm*—Harness, Dickey & Pierce

[57] ABSTRACT

For detecting the pressures occurring at a control valve pressure pickup cells are provided and for processing the pressure measuring signals evaluating electronics are provided which together with the pressure pickup cells is arranged on an intermediate plate associated with the control valve. With this arrangement signals may be formed which monitor and control the mode of operation of the consumer governed by the control valve. By arranging the components necessary for the control circuit on the intermediate plate a standardized design is made possible in which the constructional expenditure is greatly reduced.

17 Claims, 1 Drawing Sheet

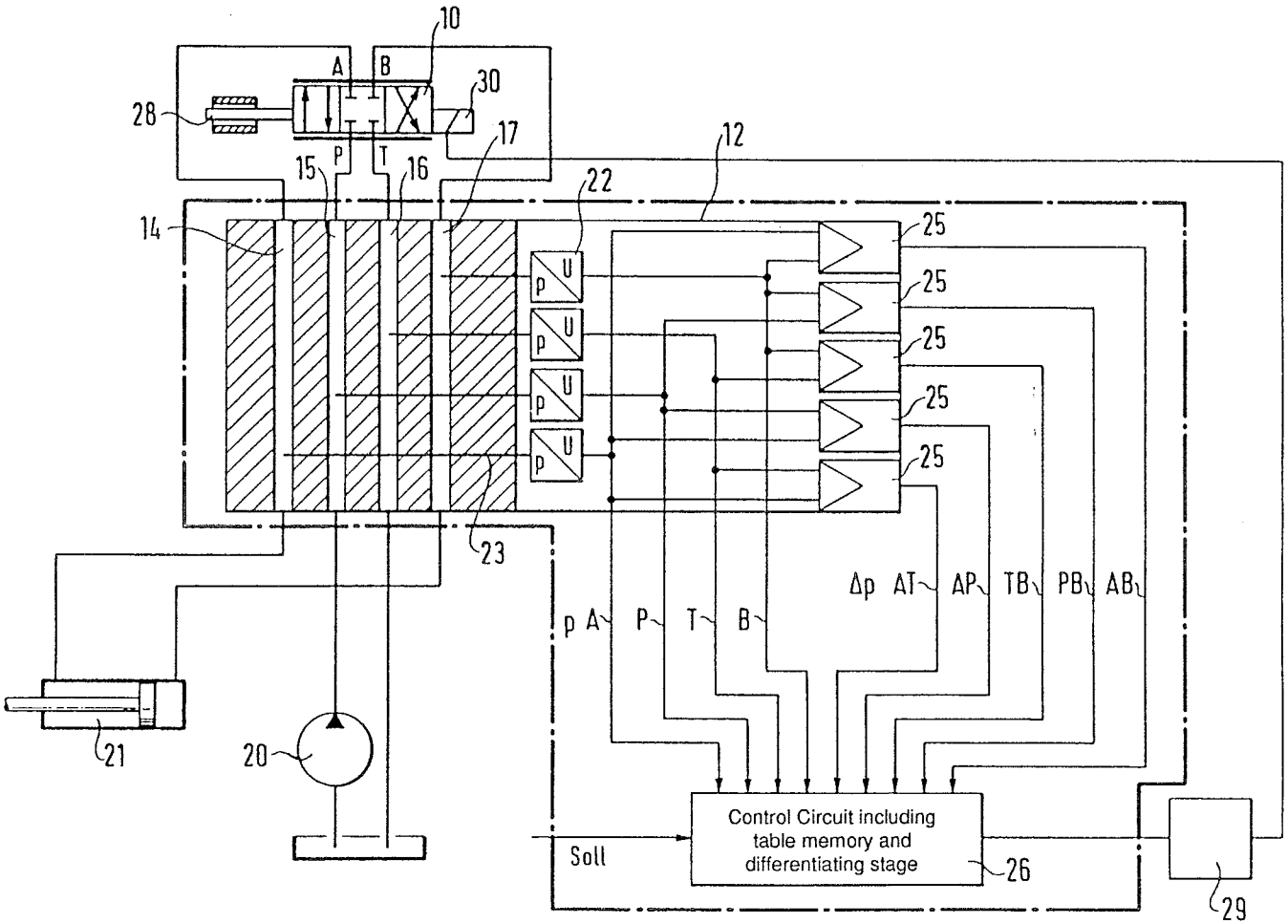
Control Circuit including table memory and differentiating stage
Soll
AB
PB
TB
AP
AT
Δp
B
T
P
p A
10
12
14
15
16
17
20
21
22
23
25
26
28
29
30

ELECTRICAL MEASURED VALUE PROCESSING FOR A CONTROL VALVE

This is a continuation of U.S. patent application Ser. No. 257,464, filed Oct. 13, 1988, now abandoned.

BACKGROUND OF THE INVENTION

The invention relates to an electrical measured value processing for a control valve.

Control valves are known as proportional valves or servo valves (MOOG P-Q proportional valve) in which a hydraulic pressure pickup is installed for detecting the pressure obtaining in a conduit leading to a consumer, in particular an injection cylinder, and/or a displacement pickup for determining the valve piston position. The two signals are supplied as actual values to a control circuit by which the proportional valve is driven in such a manner that specific pressure profiles can be followed in the injection cylinder.

It is also known in a control valve to transmit the pressure respectively upstream and downstream of the throttle cross-section via conduits to a flow control valve or the regulating means of a variable displacement pump and to subject said means to the pressure difference to adjust a specific volume flow.

The problem underlying the invention resides in providing a measured value detection or acquisition and measured value processing for a control valve which makes it possible to detect, monitor and/or influence the mode of operation of the hydraulic consumer connected to the control valve in that corresponding signals and/or signal combinations are supplied to the control circuit for driving the control valve.

SUMMARY OF THE INVENTION

With the aid of a plate associated with the control valve and a pressure measuring means provided on the plate as well as possibly logic units connected to the pressure measuring means and signal processing stages all electrical signals necessary for the desired signal processing can be acquired. Preferably, an intermediate plate is provided which is arranged between the control valve and a connection plate for the inlet (fluid source), the outlet (tank) and the working lines leading to the consumer. Pressure load cells are connected to the connecting bores. Preferably, the intermediate plate also carries the electrical signal processing stages, for example logic gate members and the control circuit, preferably in the form of a microcomputer, so that the necessary connecting lines and terminals can be largely dispensed with. The end stage for the control valve driven by the control circuit is preferably provided on the control valve itself.

The arrangement according to the invention for the measured value acquisition and processing is suitable in particular for a standardized design with uniform equipping. With a directional control valve for controlling the fluid paths between a fluid source, the tank and a consumer on the plate a pressure load cell will usually be provided at the inlet side for the admission pressure and a pressure load cell at the outlet side for each of the working conduits leading to the consumer. If desired a pressure measuring cell may also be provided for the tank pressure. This enables all the pressures occurring at the control valve to be detected.

With the aid of the evaluating electronics arranged on the plate the measuring signals are processed and the desired combined or derived signals formed. By integration of the pressure load cells and the evaluating electronics on the intermediate plate hydraulic and electrical connecting lines can be dispensed with. By using microcomputers as control circuit and serial data transmission the constructional expenditure is kept low.

In a particularly advantageous construction of the invention the evaluating electronics determine the differential pressures between the individual control edges of the control valve, i.e. the inlet-side and outlet-side difference. Together with the respective position of the valve piston of the control valve it is then possible to calculate therefrom the flow through the control valve, taking account of the geometry of the control edges of the respective control valve.

Furthermore, from the measurement of the pressure difference of the consumer and the pressure-subjected areas of the consumer the size and direction of the load of the consumer can be determined. If the working pressure of the consumer is differentiated the acceleration of the consumer can be determined and disturbing influences better detected to improve the control.

The pressure measured values supplied to the control circuit represent feedback values which also make it possible to drive the control valve in such a manner that it assumes a specific pressure (pressure control function), makes a specific acceleration possible (acceleration function) or keeps a specific flow constant (flow control function) so that an additional flow control valve for compensating different consumer loads can be dispensed with.

In advantageous further development of the invention there may be associated with each control circuit a table memory in which the flow characteristics of the respective control valve are stored and can be called up for correction. These flow characteristics can be individually determined for each individual control valve so that for each said valve a corresponding memory containing the individual characteristic of the control valve is available and thus the production expenditure for such valves can be reduced because from the memory values when called up correction values for the flow converted for the particular measured pressure conditions can be calculated. The table memory is preferably loaded with values of the flow determined in a measuring run of the control valve in dependence upon the valve piston position at a specific pressure The table memory may however also be loaded with mathematically determined values A further possible use results when the control circuit is constructed as adaptive controller and thus includes a model of the controlled system for increasing the control quality. In this case the measured signals processed by the evaluating electronics can be used as input signals for the circuits simulating the controlled system.

As control valves proportional valves or servo valves may be used. Switching magnets may also be driven by pulse modulation in such a manner that proportional behaviour can be achieved.

BRIEF DESCRIPTION OF THE DRAWING

An example of embodiment will be explained hereinafter with reference to the single FIGURE of the drawings in which a directional-control valve with intermediate plate is shown schematically.

DETAILED DESCRIPTION OF THE PREFERRED EMBODIMENT OF THE INVENTION

Screwed to a 4/3-way proportional valve 10 is an intermediate plate 12 which comprises four bores 14, 15, 16 and 17. The bore 15 establishes the connection between a pump 20 and the P-connection of the valve, the bore 16 the connection between the tank connection T and the tank and the bores 14 and 17 respectively the connection between the A-connection and B-connection of the control valve to a consumer, that is a double-acting cylinder 21.

The bores 14 through 17, which contrary to the schematic illustration do not lie in a common plane, communicate each via a passage 23, indicated only schematically, with a respective pressure load cell 22. Since the intermediate plate 12 is shown schematically in the drawings the components which are mounted on this intermediate plate are contained within the dot dash lines in the FIGURE. The outputs of the pressure load cells 22 thus carry signals for the pressures A, B, P and T.

In a simplified embodiment the pressure measuring cell for the tank pressure T can be omitted and said pressure can be assumed to be zero. If however the consumer displaces relatively large amounts of fluid the tank pressure may rise to considerable values and consequently it is advisable to measure the pressure T.

Also arranged on the intermediate plate 12 is a logic circuit 25 consisting of individual summation stages which each have two inputs for pressure measured values and an output for the differential pressure determined. In this manner the differential pressures AT, AP, BT, BP and AB are determined.

The signals corresponding to the pressures or pressure difference are supplied to evaluating electronics or a control circuit 26 in which further units not shown in detail such as a table memory and differentiating stage are provided for the signal processing. It is possible to supply to the control circuit as feedback quantity the valve piston position which is measured by a displacement pickup 28. Furthermore, the control circuit receives desired value signals for a pressure to be adjusted and a flow to be adjusted as well as desired values for other quantities such as acceleration and pressure differences to be observed. In connection with the feedback quantities the control circuit generates control signals which are supplied via an end stage 29 preferably arranged at the control valve to the proportional magnet 30 of the control valve 10.

What is claimed:

1. Electrical measured value processing for operating a control valve having a body with external connections for respective connection to a fluid source, a tank and at least one working conduit, characterized in that a plate having passages affixed to said valve body with said passages being in communication with at least some of said eternal connections, pressure measuring means carried by said plate for detecting the pressure in at least one of said passages and outputting an electrical signal representative of pressure, and processing means carried by said plate for receiving said signal and having a program for providing a signal to operate said control valve.

2. Measured value processing according to claim 1, characterized in that the plate is formed as intermediate plate and comprises bores for connection to the connections of the control valve and communicating said connections to the fluid source, the tank and a consumer.

3. Measured value processing according to claim 2, characterized in that a measuring means is provided for measuring the pressure of the fluid source and of the pressure at each of two pressure conduits leading to a consumer.

4. Measured value processing according to said claim 2, characterized in that the processing means include a control circuit arranged on the intermediate plate.

5. Measured value processing according to claim 4, characterized in that the control circuit is formed by a microcomputer.

6. Measured value processing according to claim 1, characterized in that the processing means include a summation stage for indicating the pressure difference between an inlet-side and an outlet-side pressure.

7. Measured value processing according to claim 1, characterized in that the processing means include a differentiating stage by which a pressure change rate is determined from at least one of the pressure values.

8. Measured value processing according to claim 7, characterized in that from the pressure change rate measured by the differentiating stage acceleration of a consumer in fluid communication with the at least one working conduit is determined.

9. Measured value processing according to claim 1, characterized in that from the pressure and a signal from means for determining the position of a piston of the valve, volume flow is calculated by the processing means for determining speed of a consumer in fluid communication with at least one working conduit.

10. Measured value processing according to claim 1, characterized in that from the pressure and areas of a consumer in fluid communication with the at least one working conduit, magnitude and direction of a load of the consumer are determined by the processing means.

11. Measured value processing according to claim 1, characterized in that from flow and the pressure hydraulic output of a consumer in fluid communication with the at least one working conduit is determined by the processing means.

12. Measured value processing according to claim 1, characterized in that values determined by the processing means are compared as actual values with a desired value for generating a correcting variable for a valve piston of the control valve and controlling the control valve.

13. Measured value processing according to claim 1, characterized in that the processing means is programmed with a table memory for the geometry of a piston of the control valve.

14. Measured value processing according to claim 13, characterized in that the table memory is loaded with values which are determined mathematically on the basis of the valve piston position and associated flow cross-sections at a predetermined pressure.

15. Measured value processing according to claim 13, characterized in that the table memory is loaded with values determined in a measuring run of the control valve.

16. Measured value processing according to claim 13, characterized in that the processing means take from the table memory a flow valve corresponding to the position of a piston of the control valve at a given pressure and converts this to a flow value applicable to the particular pressure measured.

17. Measured value processing according to claim 16, characterized in that the values determined are employed for estimating parameters for a model of the controlled system in an adaptive controller.

* * * * *